US006285850B1

(12) United States Patent
Van Weverberg et al.

(10) Patent No.: US 6,285,850 B1
(45) Date of Patent: Sep. 4, 2001

(54) DUPLEX PRINTER AND METHOD OF PRINTING TO ENSURE DESIRED REGISTRATION OF IMAGES ON OPPOSITE FACES OF SUBSTRATE WEB

(75) Inventors: Erik Gabriel Geradus Van Weverberg, Mortsel; Kris Dons, Lint, both of (BE)

(73) Assignee: Xeikon NV, Mortsel (BE)

( * ) Notice: Subject to any disclaimer, the term of this patent is extended or adjusted under 35 U.S.C. 154(b) by 0 days.

(21) Appl. No.: 09/644,582

(22) Filed: Aug. 24, 2000

(30) Foreign Application Priority Data

Aug. 25, 1999 (GB) ..... 9920012

(51) Int. Cl.[7] ..... G03G 15/20
(52) U.S. Cl. ..... 399/309; 226/42
(58) Field of Search ..... 399/309; 226/42

(56) References Cited

U.S. PATENT DOCUMENTS 4,852,785 * 8/1989 Bettendorf et al. ..... 226/42

FOREIGN PATENT DOCUMENTS 0 762 226 A2 3/1997 (EP) .
0 871 082 A1 10/1998 (EP) .

* cited by examiner

*Primary Examiner*—Quana M. Grainger
(74) *Attorney, Agent, or Firm*—Larson & Taylor PLC

(57) ABSTRACT

A duplex printer has drive motors for driving transfer surfaces carrying toner particle images to transfer stations at which the images are transferred to opposed faces of a substrate web. A web drive motor drives the substrate web through the transfer stations. Sensors sense movement of the transfer surfaces and a control device controls the drive motors in response to signals received from the sensors. Thereby desired registration between the first and second images at a desired location on the substrate web is ensured.

12 Claims, 3 Drawing Sheets

DUPLEX PRINTER AND METHOD OF PRINTING TO ENSURE DESIRED REGISTRATION OF IMAGES ON OPPOSITE FACES OF SUBSTRATE WEB

FIELD OF THE INVENTION

The present invention relates to a duplex printer and to a method of duplex printing.

BACKGROUND TO THE INVENTION

In a duplex web-fed printer such as described in United States patent U.S. Pat. No. 5,805,967 (De Bock et al. / Xeikon NV), and European patent specification EP 0871082 (Xeikon NV), moving transfer surfaces in the form of transfer belts carry toner particle images to transfer stations at which the images are transferred to opposed faces of a paper web. The paper web passes through nips at the transfer stations.

It is often desirable to ensure registration of the image printed on one face of the web with the image printed on the opposite face of the web. This can be particularly the case when the web is formed of a transparent or semi-transparent material and/or perforations or other physical modifications extending through the web material need to be aligned with specific parts of both images.

It is an objective of the present invention to enable such back-to-back registration to be achieved in a simple manner.

SUMMARY OF THE INVENTION

We have now discovered that this objective, and other useful benefits, can be obtained when a separate drive device is provided for the web, sensors are used to sense the movement of the transfer surfaces and the movements of the transfer surfaces and of the web are controlled in response to signals received from the sensors.

Thus, according to a first aspect of the invention there is provided a duplex printer comprising:

a first transfer surface drive device for driving a first transfer surface carrying a first toner particle image to a first transfer station at which the first toner particle image is transferred to one face of a substrate web; and a second transfer surface drive device for driving a second transfer surface carrying a second toner particle image on the second transfer surface to a second transfer station at which the second toner particle image is transferred to the opposite face of the substrate web; characterized by a web drive device for driving the substrate web along a substrate web path through the first and second transfer stations;

a first transfer surface movement sensor for sensing movement of the first transfer surface;

a second transfer surface movement sensor for sensing movement of the second transfer surface;

a control device for controlling the first, second and transfer surface drive devices and said web drive device in response to signals received from the first and second transfer surface movement sensors thereby to ensure desired registration between the first and second images at a desired location on the substrate web.

According to a second aspect of the invention, there is provided a method of duplex printing comprising:

driving a first transfer surface carrying a first toner particle image to a first transfer station at which the first toner particle image is transferred to one face of a substrate web; and driving a second transfer surface carrying a second toner particle image on the second transfer surface to a second transfer station at which the second toner particle image is transferred to the opposite face of the substrate web; characterized by driving the substrate web along a substrate web path through the first and second transfer stations;

sensing movement of the first transfer surface;

sensing movement of the second transfer surface; and controlling the movements of said first and second transfer surfaces and the substrate web in response to signals received from the first and second transfer surface movement sensors thereby to ensure desired registration between the first and second images at a desired location on the substrate web.

In the prior art duplex web-fed printers, such as that described in United States patent U.S. Pat. No. 5,805,967, the paper web passes through nips at the transfer stations so that it is the movement of the transfer members on which the transfer surfaces are located which drives the web. At the start up of the printer, initial movement of the transfer members causes initial movement of the web. As a result, the initial images are printed at some distance from the leading end of the web, i.e. there is a significant waste of web material. Such waste is undesirable.

According to a preferred aspect of the present invention, at start-up of the printer, movement of the substrate web is delayed to ensure the positioning of the first and second images at a predetermined location on the substrate web. For example, at start-up of the printer, initial movement of the transfer surfaces occurs while the substrate web is stationary and separated from the transfer surfaces at the transfer stations.

The first and second transfer members may be positioned in opposition to each other to form a transfer nip therebetween, through which the substrate path passes. Alternatively, the first and second transfer members are spaced from each other, each being provided with a respective counter pressure roller to define a nip or contact region through which the substrate passes. A more consistent output quality can be obtained if the substrate web wraps partially around the pressure roller both in advance of and following the transfer nip and the temperature of the pressure roller is controlled. Preferably, the printer further comprises means for controlling the pressure exerted by the pressure roller at the transfer nip. A suitable pressure is from 0.1 to 1.0 $N/mm^2$, depending upon the materials of which the pressure roller, the transfer member and the substrate are formed, and this pressure may be controlled by mounting the pressure roller in a movable manner by way of adjustable springs or by the use of a controllable linear motor.

The substrate path preferably has a wrapping angle about the pressure roller of at least 10° in advance of the transfer nip. With a smaller wrapping angle, the substrate will only be in contact with the surface of the pressure roller over a short distance before reaching the transfer nip, unless a pressure roller with a large diameter is used. The longer the distance over which the substrate is in contact with the pressure roller, the more complete is the transfer of heat from the pressure roller to the substrate. In general, transfer of heat from the pressure roller to the substrate is more complete when the contact time is high, that is when (i) the wrapping angle is high, (ii) the pressure roller diameter is high, and (iii) the speed of the substrate through the transfer nip is low. The transfer of heat is also influenced by the nature of the material of which the substrate is formed and the surface characteristics of the pressure roller.

The wrapping angle of the substrate path about the pressure roller beyond of the transfer nip need only be small, for example at least 1°. This encourages good separation of the substrate carrying the toner image from the transfer member.

There is no theoretical upper limit to the total wrapping angle, other than that imposed by the geometry of the printer. Usually however a total wrapping angle of up to about 180° will suffice.

The temperature of the pressure roller is preferably controlled to a temperature of from 40 to 100° C., most preferably from 60 to 80°C.

When the second transfer station is downstream of the first transfer station it is preferred that each transfer station has an open position in which the substrate web is separated from the transfer surface and a closed position in which the substrate web makes contact with the transfer surface. The control device may be adapted to control the closure and opening of each transfer station.

Each transfer station may comprises a movable counter roller in rolling contact with the substrate web, the counter roller being movable between a position in which the counter roller forms a nip with the transfer surface, through which nip the substrate web passes, and a position spaced from the transfer surface. The counter roller is preferably movable between the open and closed position along such a path that the substrate web length remains substantially the same. For example, the counter roller may move along a curved path which has its center located on a line bisecting the wrapping angle of the web around the roller. This enables the web to be brought up to a speed corresponding to that of the transfer surface before the transfer station is closed, reducing the risk of shock occurring as the substrate web contacts the moving transfer surface. In an alternative embodiment, movement of the counter roller towards the closed position is coupled with the control of the web drive device to bring the speed of the web up to that of the transfer surface as the counter roller approaches the closed position.

Preferably, the transfer member is driven along a continuous path. The transfer member plays the role of transferring the toner image to the substrate. It is not necessary therefore that the transfer member has a photoconductive surface. Indeed, the need to heat the transfer member means that the use of conventional photoconductor materials is to be avoided, since the photoconductive properties of such materials are sensitive to temperature changes.

The transfer member may comprise an outer surface formed of a material having a low surface energy, for example silicone elastomer (surface energy typically 20 dyne/cm), polytetrafluoroethylene, polyfluoralkylene and other fluorinated polymers. The transfer member is preferably in a form having a low mass, so that the surface thereof can be easily heated prior to the transfer of the multiple toner image to the substrate. For this reason, while each transfer member can be in the form of a transfer roller or drum, it is preferably in the form of a transfer belt, for example an endless metal belt of 40 $\mu$m thickness coated with 40 $\mu$m thickness silicone rubber.

The transfer member may comprise a heat conductive backing carrying a coating of non-adhesive material, preferably a silicone rubber. In any event, the transfer member should have a low thermal capacity, to ensure the rapid heating and cooling thereof. Such rapid temperature changes enable the apparatus to be smaller in size than would otherwise be necessary. The transfer member should also be formed primarily of a heat conductive material, if heating from the "back-side" thereof is to be used. Ak heat-conductive transfer member has the advantage of distributing a more even temperature, as "hot spols" are avoided. The transfer member, or at least the coating carried thereon, should be seamless, especially since a substrate in web-form is to be used. The transfer member is preferably impermeable. The transfer surface is also preferably impermeable.

Each transfer surface movement sensor may be in the form of an encoder. For example, the encoder is a rotational encoder associated with an image forming drum which is in contact with a primary belt to deposit toner particle images thereon, the primary belt being in operative contact with the transfer surface to enable the toner particle image to be transferred to the transfer surface.

The printer according to the invention may further comprise a web movement sensor for sensing movement of the substrate web, the control device being adapted to control the web drive device in response to signals received from the first and second transfer surface movement sensors and from the web movement sensor to ensure synchronous movement of the substrate web with the first and second transfer surfaces.

The invention is applicable both to monochrome and to multi-color printers, especially single pass multi-color printers. A plurality of toner images of different colors are preferably electrostatically deposited in powder form in register with each other onto the transfer member to form a charged multiple toner image thereon. By specifying that the plurality of toner images of different colors are electrostatically deposited onto the moving transfer member to form a charged multiple toner image thereon, we mean that either (Option 1) the multiple toner image is firstly formed on another member and then deposited as such onto the transfer member, or (Option 2) a plurality of toner image deposition devices operate sequentially at different locations along the transfer member path to deposit toner images on the transfer member. In the latter alternative, the operation of the toner image deposition devices is so controlled in relation to each other as to ensure the desired registration of the various color separation images.

Thus, according to one embodiment, the transfer member is an intermediate transfer member and a primary transfer member is guided past a set of toner image producing stations whereby a plurality of toner images of different colors are formed on the primary transfer member in register with each other to form the multiple toner image on the primary transfer member, the intermediate transfer member being in contact with the primary transfer member downstream of the image producing stations, and the multiple toner image is electrostatically transferred from the primary transfer member to be deposited on the intermediate transfer member. In this embodiment, the primary transfer member is preferably constituted by a primary belt.

The primary belt may have, for example, a toner image carrying surface formed of an electrically non-conductive material. The electrically non-conductive material is preferably selected from polyethylene terephthalate, silicone elastomer, polyimide (such as KAPTON—Trade Mark), and mixtures thereof. The primary belt may consist entirely of this material, or be in the form of a base material coated with such an electrically non-conductive material. The base material of the primary belt may be a metal, such as stainless steel, a polyimide, a polyvinyl fluoride, a polyester, and mixtures thereof. Polyester has the advantage of good mechanical and electrical characteristics and of being less sensitive to humidity.

Drive to the primary belt is preferably derived from the drive means for the intermediate transfer member, by making use of adherent contact between the primary belt and the intermediate transfer member causing the primary belt and the intermediate transfer member to move in synchronism with each other. Adherent contact between the primary belt and the image producing stations may be used to ensure that the image producing stations move in synchronism with the primary belt. The primary belt preferably passes over a guide roller positioned in opposition to the intermediate transfer member to form a contact region therebetween.

Means for cleaning the primary belt are preferably provided after contact with the intermediate transfer member.

Means for tensioning the primary belt may be provided in order to ensure good registration of the toner images thereon and to improve the quality of transfer of the multiple toner image therefrom to the intermediate transfer member. Means for controlling the transverse position and movement of the primary belt may also be included.

Each toner image producing station may comprise a drum with a photoconductive surface, means for forming an electrostatic latent image on the drum surface, means for developing the electrostatic image to form a toner image on the drum surface and a transfer device for transferring the toner image onto the primary belt. The transfer device may comprise a transfer roller located at the face of the primary belt opposite to the drum, or a corona transfer device. When the transfer device is a transfer roller, the primary belt is in contact with the drum over a contact angle of less than 5°, measured at the axis of the rotatable endless surface means, e.g. substantially tangential contact. However, when the transfer device is a corona transfer device, the primary belt is preferably in contact with the drum over a contact angle of more than 5° so that adherent contact between the primary belt and the rotatable endless surface means enables drive to be reliably transmitted from the primary belt to the drum. The reliability of this transfer is enhanced by tensioning the primary belt.

For the production of glossy images, it is advisable that the surface of the transfer member be as flat as possible. In particular it is advantageous if the surface roughness $R_a$ is less than 0.2 $\mu$m. For the production of matt images, the surface roughness may be higher.

The transfer member may be heated by infra-red radiant heating means, although other forms of heating including HF radiation, induction heating, convection heating and conduction heating, for example the use of heated rollers, are also suitable. The temperature to which the toner image on the transfer member is heated is important. In particular, the surface of the toner image should contact the substrate at a temperature above the fluid temperature of the toner, so as to ensure mixing of the toner particles of different colors, complete transfer of the mixed multiple toner image to the substrate and the fixing of the image on the substrate. The fluid temperature is the temperature at which the viscosity of the toner falls below 50 Pa s, such as from 10 Pa s to 40 Pa s. This temperature to which the multiple toner image is heated is above the glass transition temperature of the toner but below the degradation temperature thereof, that is below the temperature at which irreversible changes occur in the toner composition leading to a significant change in its spectral properties. The fluid temperature is typically above 150° C., even above 200° C., depending upon the composition of the toner. Viscosity is typically measured by the use of a cup viscometer (Ford cup, Shell cup or Zahn cup). ASTM D-1200 is an accepted standard for the measurement of viscosities of printing inks. Laray and Churchill falling rod viscometers may also be used.

The heating means may comprise a heating surface in contact with the transfer member, such as a roller, or a heated stationary body over which the transfer member passes. Heating may be achieved, for example, by passing a heating fluid (e.g. steam or hot oil) at an elevated temperature through the roiler or stationary body, or by the provision of radiant heating means positioned within the roller or stationary body. It is also possible to use radiant heating means for directly heating the transfer member, and this may be especially beneficial where the transfer member is formed primarily of heat non-conductive material. Generally, the transfer member will be heated from the side thereof opposite to its contact with the substrate. Generally, the transfer member contacts the substrate with a dry surface, i.e. there is no need to apply a liquid release agent to the transfer member surface.

The multiple toner image may be heated to a temperature of more than the glass transition temperature $T_g$, e.g. more than 200° C., but below the degradation temperature of the toner.

Due to the fact that dry toner images have a high thickness (sometimes more than 10 $\mu$m), the appearance of such images is sometimes unnatural and non-uniform and these images usually have a non-uniform color saturation. While this appearance is acceptable for many applications, it is sometimes desired to provide an image having a different appearance or finish. By the term "finish" in the context of the present invention, we mean either a surface characteristic which is glossy, i.e. highly reflective, and/or which provides high saturation of colors, this usually being achieved by reducing the scattering of light from the surface of the printed article, or both such characteristics. For example, a glossy appearance is especially desirable where the receiving material itself has a glossy surface. A higher degree of color saturation can be very desirable in high quality print work.

When the transfer member is positioned in opposition to a pressure roller to form a transfer nip therebetween, through which the substrate web passes, it is possible to provide, downstream of the transfer nip, a glossing roller positioned in opposition to the pressure roller to form a supplementary glossing nip through which the substrate passes. The substrate passes through this glossing nip at a temperature determined by the temperature of the substrate, which is much less than the temperature of the toner at the transfer nip.

The substrate is in the form of a web. Web cutting means, optionally together with a sheet stacking device may be provided downstream of the transfer member. Alternatively, the web is not cut into sheets, but wound onto a take-up roller. The web of substrate may be fed through the printer from a roll. If desired, the substrate may be conditioned (i.e. its moisture content adjusted to an optimum level for printing), prior to entering the printer.

In an embodiment of Option 2, the primary belt and the transfer member are constituted by one and the same member. The transfer member may be constituted by a belt and there are provided means for guiding the belt past a set of toner image producing stations whereby a plurality of toner images of different colors are transferred to the belt in register with each other to form the multiple toner image on the belt, and the substrate feed means are arranged to feed substrate along a substrate path into contact with the belt.

In order not to disturb the multiple toner image on the transfer member between the deposition of the image thereon and the transfer of the image to the substrate, we prefer that the surface of the transfer member which carries the image is free of contact with any other member. Thereby, undesirable transfer of the image, or a part thereof, from the transfer member is avoided. Thus, where for example the transfer member is in the form of a belt, it should be ensured that guide rollers or other guide means only contact the belt on the surface thereof opposite to that carrying the image, at least between the deposition of the image and its transfer to the substrate.

The printer according to the invention may also be part of an electrostatic copier, working on similar principles to those described above in connection with electrostatic printers. In copiers however, it is common to expose the rotatable endless surface exclusively by optical means, directly from the original image to be copied.

BRIEF DESCRIPTION OF THE DRAWING

The invention will be described in further detail, purely by way of example, with reference to the accompanying drawings, in which.

DETAILED DESCRIPTION

Figure 1:
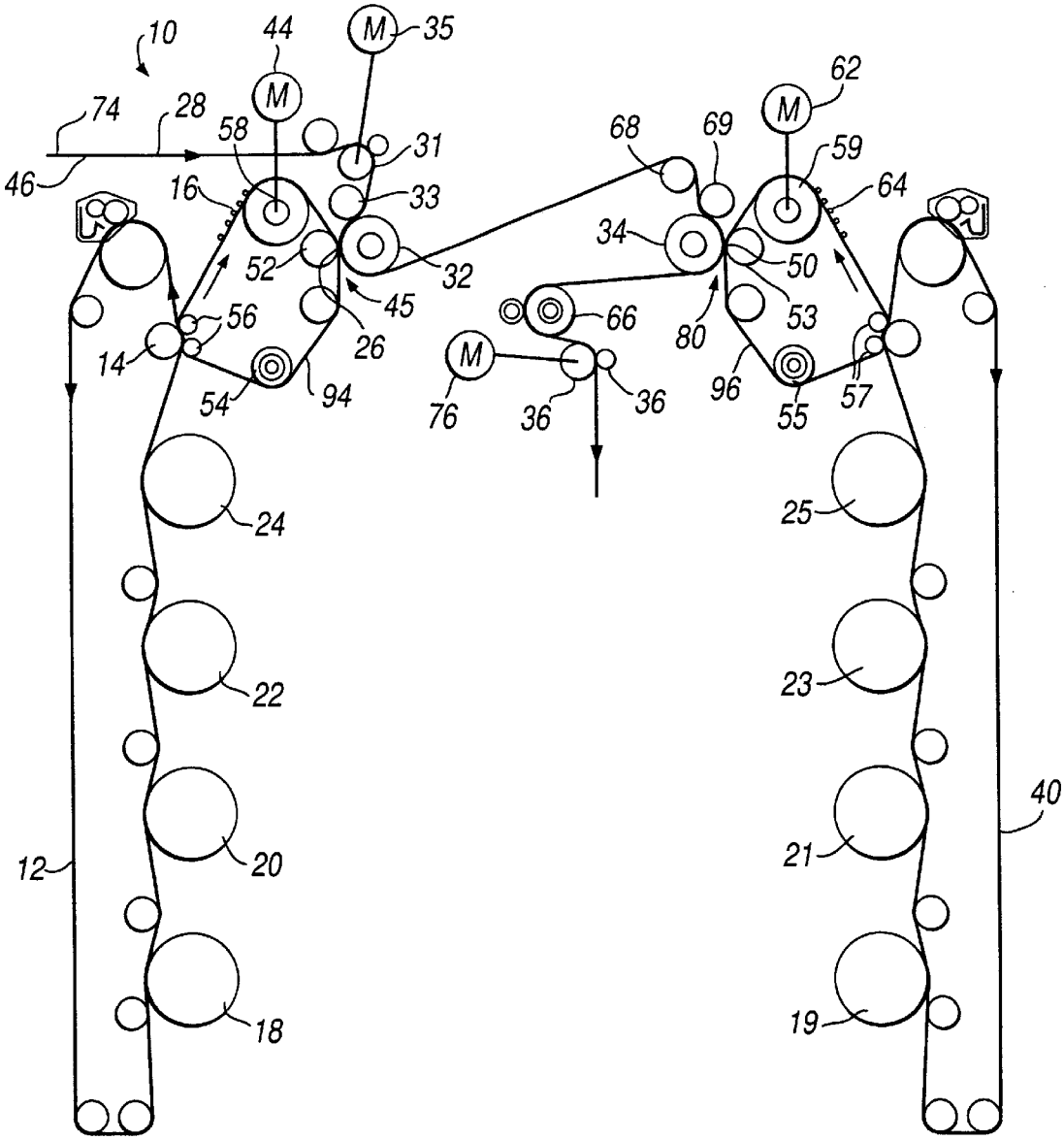
FIG. 1 shows, in a diagrammatic form, the mechanical features of a single pass, multi-color duplex electrostatographic printer according to an embodiment of the invention.
Figure 2:
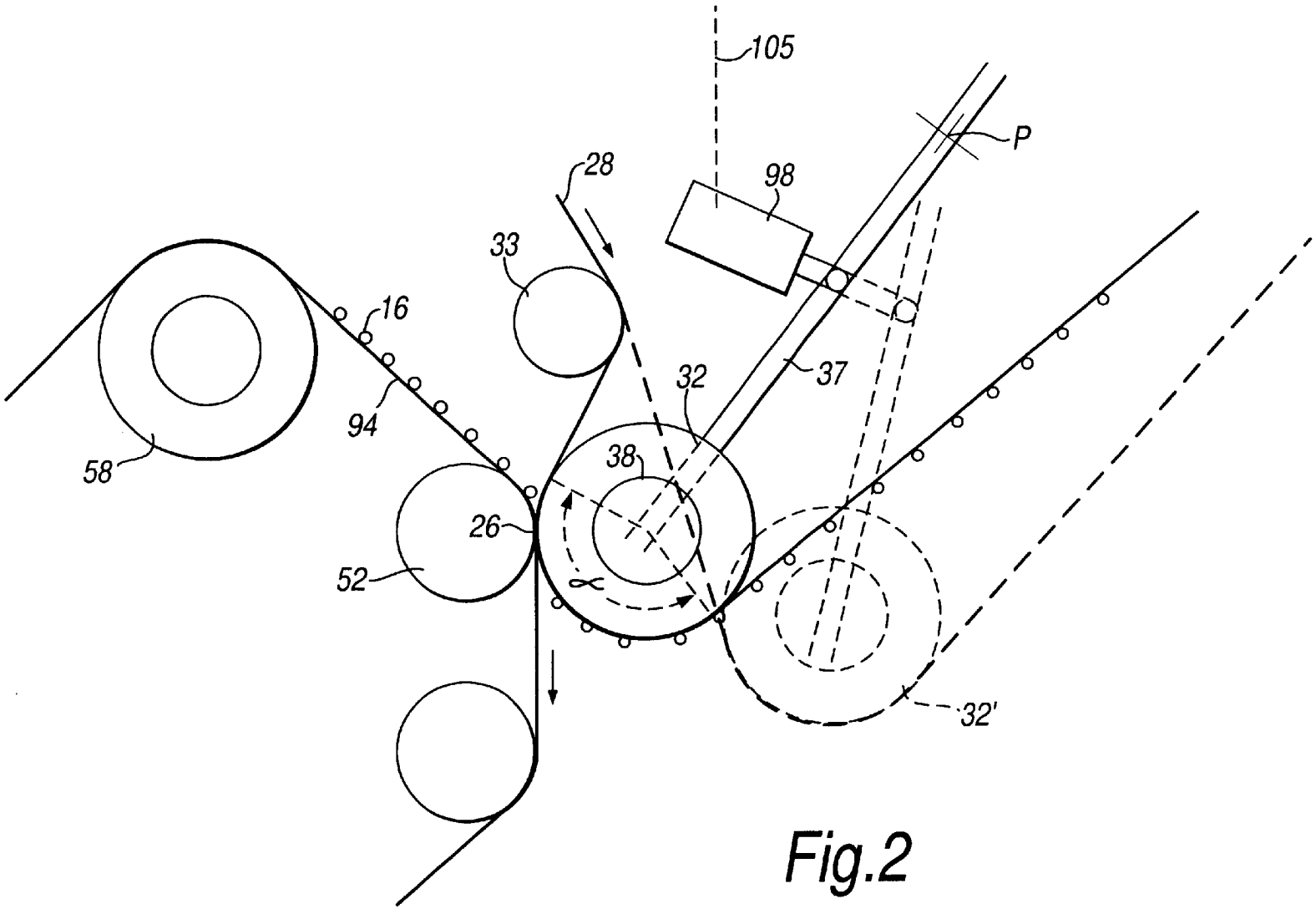
FIG. 2 is an enlarged portion of FIG. 1.

FIGS. 1 and 2 show a single pass, multi-color duplex electrostatographic printer 10. The printer comprises a first primary seamless belt 12 passing over guide rollers, including a guide roller 14. The primary belt 12 moves in a substantially vertical direction past a set of four toner image producing stations 18, 20, 22, 24. At the four toner image producing stations 18, 20, 22, 24, a plurality of toner images of different colors are transferred by transfer coronas (not shown) to the primary belt 12 in register with each other to form a first multiple toner image 16, as described in more detail in European patent application EP 629927 (Xeikon NV). These image producing stations may be similar to each other except in respect of the color of the toner with which they are supplied. The primary belt 12 has a toner image carrying surface formed for example of polyethylene terephthalate. Means may be provided for tensioning that part of the primary belt 12 which extends past the toner image producing stations 18, 20, 22, 24.

A transfer member in the form of an earthed seamless transfer belt 94, is in contact with the primary belt 12 downstream of the last image producing station 24. In this embodiment, the transfer belt is in the form of a metal band of 70 $\mu$m thickness carrying a 25 $\mu$m thickness silicone rubber coating. The transfer belt 94 passes over spaced guide rollers, including guide rollers 52 and 58, and a guide roller pair 56 which are so positioned as to bring the transfer belt 94 into contact with the toner image carrying belt 12 as it passes over its upper guide roller 14. The transfer belt 94 is preferably tensioned by means not shown, for example by spring loading one of the guide rollers.

Drive is transmitted in turn from a drive motor 44 to the guide roller 58, via the transfer belt 94 to the primary belt 12 downstream of the toner image producing stations and to the toner image producing stations themselves.

The guide roller 14 and the transfer belt 94 are positioned in opposition to each other to form a contact region therebetween, through which the primary belt 12 passes. Adherent contact between the primary belt and the transfer belt causes the primary belt, the image producing stations, and the transfer belt to move in synchronism with each other.

A multiple toner image 16 (see also FIG. 2) adhering to the surface of the primary belt 12 is transferred to the moving transfer belt 94 by a second function of guide roller 14 acting as an electrostatic transfer roller connected, for example, to −1000 V.

The first drive motor 44 drives the first transfer belt 94 carrying the first toner particle image 16 to a first transfer station 45 at which the first toner particle image 16 is transferred to one face 46 of a paper web 28.

In a typical embodiment, a heating roller 58 raises the temperature of the multi-color toner image 16 on the transfer belt 94 to about 110°C., the optimum temperature for final transfer to the paper web 28. By the use of an elevated temperature at the point of transfer to the paper web 28, and by virtue of the higher surface energy of the paper web relative to the transfer belt 94, the transfer of toner is 100% complete, so that there may be no necessity to clean excess toner particles from the transfer belt. Following transfer of the image from the transfer belt 94 to the web 28, the transfer belt passes over a cooling roller 54.

The printer is adapted for duplex printing. To achieve this, the printer further comprises a second primary belt 40 which moves past a second set of four toner image producing stations 19, 21, 23, 25. At the four toner image producing stations 19, 21, 23, 25, a plurality of toner images of different colors are transferred to the primary belt in register with each other to form a second image.

A second transfer belt 96 is in contact with the second primary belt 40 downstream of the last image producing station 25 of the second set. The second transfer belt is guided over guide rollers, including guide rollers 53 and a guide roller pair 57, heating roller 59 and cooling roller 55.

A second drive motor 62 drives the second transfer belt 96 carrying the second toner particle image 64 on the second transfer belt 96 to a second transfer station 80 at which the second toner particle image 64 is transferred to the opposite face 74 of the paper web 28.

The paper web 28 is unwound from a supply roll (not shown) and passes into the printer. The web passes over a brake roller 31 which is driven by a motor 35 that acts as a brake to control tension in the substrate web. The substrate web then passes over a guide roller 33 to the first transfer nip 26, defined between the transfer belt 94 and a freely rotating counter pressure roller 32 opposed to the guide roller 52. The pressure roller 32 is heated with an internal heating lamp. The web then passes to the second transfer nip 50 defined between the second transfer belt 96 and a counter pressure roller 34, opposed to guide roller 53. The counter pressure roller 34 is similar in construction to the counter pressure roller 32. The web then passes to a pair of web drive rollers 36, driven by a motor 76. Downstream of the drive roller pair 36, the paper web may pass to a cutting station where the web is cut into sheets which are collected in a stack. A cooling roller 66 in advance of the drive rollers 36, to reduce the risk of damage to the substrate and the toner images fixed thereon, as the web progresses further through the apparatus.

The web substrate which passes between the nips 26 and 50, over a guide roller 68. A strain gauge roller may also be provided between the nips 26 and 50 to measure the tension in the web. This strain gauge roller may be provided with an internal heating lamp.

Figure 3:
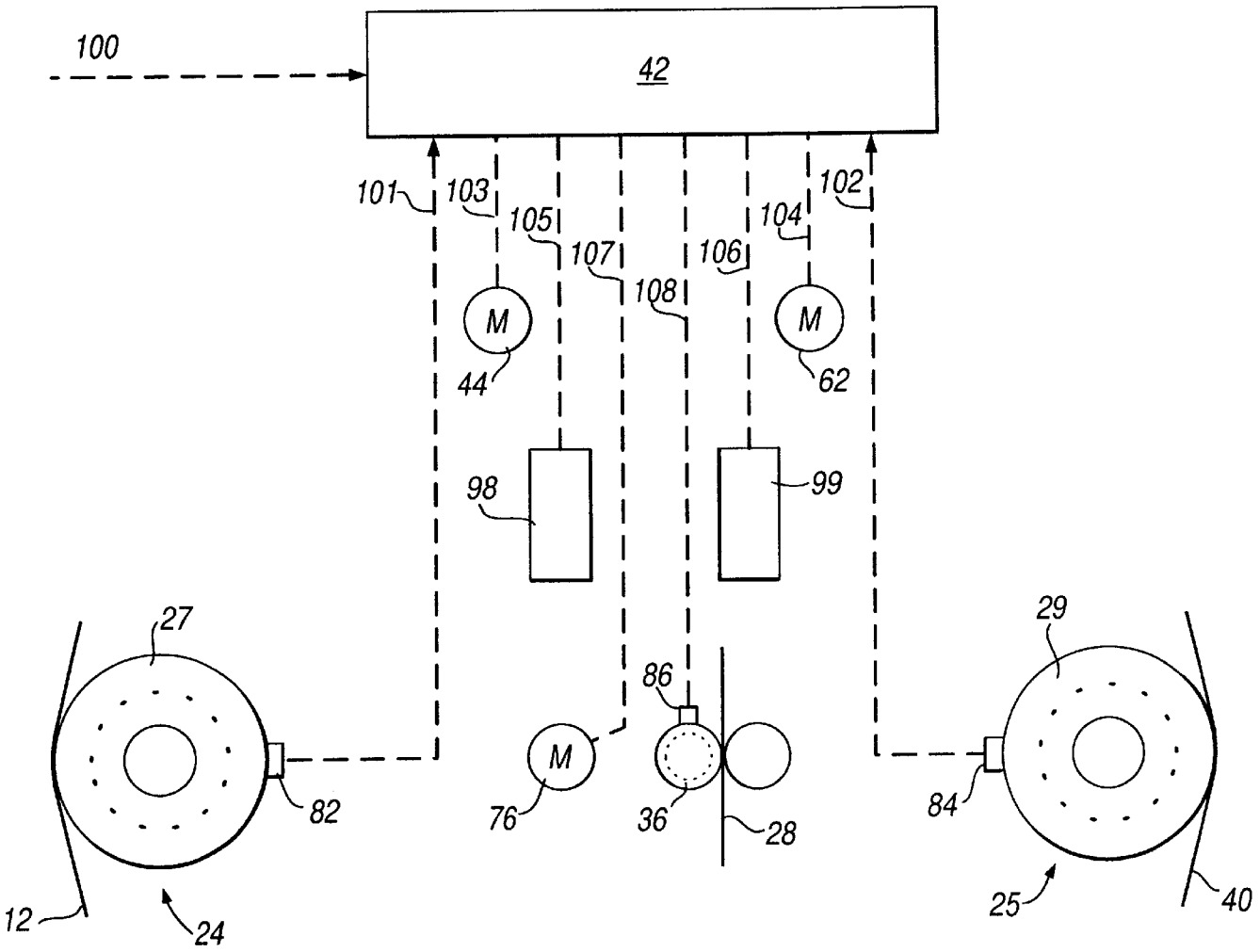
FIG. 3 is an enlarged portion of FIG. 1 showing the control system.

Referring to FIG. 3, it will be seen that a first rotational encoder 82 is carried on an image forming drum 27 of one of the image producing stations 24. The encoder 82 generates a signal indicative of the movement of the first primary belt 12 and hence of the transfer belt 94.

A second rotational encoder 84 is carried on an image forming drum 29 of one of the image producing stations 25. The encoder 84 generates a signal indicative of the movement of the second primary belt 40 and hence of the second transfer belt 96.

The encoders 82, 84 are connected to a control device, such as a microprocessor 42, by lines 101, 102. The control device 42 has output lines 103, 104 which are connected to the drive motors 44, 62 respectively and an output line 107 connected to the web drive motor 76. One of the drive rollers 36 driven by the drive motor 76 carries a third encoder 86 which is connected to the control device 42 by line 108. The control device 42 also has an input line 100 to receive data from the printer controller (not shown), particularly concerning the desired positioning of images on the printed web.

In use, the control device 42 controls the drive motors 44, 62, 76 in response to signals received from the encoders 82, 84 thereby to ensure desired registration between the first and second images 16, 64 on the paper web 28.

As can be seen more clearly in FIG. 2, the paper web 28 is in contact with the counter roller 32 over a wrapping angle of $\alpha°$. The counter roller 32 is temperature controlled. When the printer is first used after a period of rest, the counter roller 32 is approximately at room temperature. The temperature control fluid therefore needs Lo be heated in order to raise the temperature of the counter roller 32. As printing proceeds, some heal is transferred from the transfer belt 94, which is at about 160° C. through the substrate 28 to the counter roller 52. The temperature control fluid now needs to be cooled in order to keep the temperature of the counter roller 32 at about 70° C. A substantially constant temperature difference is therefore established across the transfer nip 26, leading to a substantially constant transfer quality.

The counter roller 32 is carried on arms 37 which are pivoted about a fixed point P, which lies on a line bisecting the wrapping angle $\alpha$. The counter roller 32 may be switched between a closed position (as shown) and an open, or retracted, position by operation of a stepper motor 98 with force measurement feedback connected to the control device 42 by way of a line 105. In the closed position as shown in full lines, the paper web path 78 makes contact with the first transfer belt 94. In the open position, as shown in broken lines, the paper web path 78 is separated from the first transfer belt 94. By pivoting the arms 37 about a pivot point lying on a line bisecting the wrapping angle, it is ensured that the web path length is the same in both the open and closed positions.

The stepper motor 98 is so controllable that the pressure which the counter roller 32 exerts at the transfer nip 26 is adjustable. A suitable pressure is about 0.3 $N/mm^2$, which is achieved by the mounting springs exerting a force of 400 N at end of the roller, the rollers having a length of 300 mm and the nip having a length of about 8 mm.

Similarly, the second counter roller 34 may be switched between a closed position and an open position by operation of a stepper motor 99 connected to the control device 42 by Line 106 (see FIG. 3).

The printer operates as follows.

At start-up, in response to a START signal on line 100, the control device 42 causes the motor 44 to start, thereby starting the first image forming process on the primary belt 12. The initial first image 16 is transferred to the transfer belt 94 which moves towards the first transfer station 45. During this time, pulses from the encoder 82 are fed via line 101 to the control device 42. When a predetermined number of pulses have been received, the control device 42 causes the motor 62 to start, thereby starting the second image forming process on the second primary belt 40. The initial second image 64 is transferred to the second transfer belt 96 which moves towards the second transfer station 80. In an alternative embodiment, movement of the second transfer belts 94, 96 is started substantially simultaneously, image forming on the primary belts being delayed until the transfer belts reach a target temperature. In either embodiment, during movement of the transfer belts 94, 96, puLses from both encoders 82 and 84 are received by the control device 42, which checks that they are in mutual synchronism. Should any lack of synchronism be detected, the control device 42 adjusts the speed of either motor 44 or motor 62, or both, in compensation. This continual monitoring and speed adjustment continues throughout the printing process.

Up to this point in Lime, both transfer stations 45 and 80 are in their "open" positions, the web motor 76 is not operating and the web 28 is consequently stationary.

After the control device 42 has received a further predetermined number of pulses from the encoder 82, it causes the web feed motor 76 to be started, to run the web at the same linear speed as that of the transfer belts 94 and 96. From this point in time, pulses from the encoder 86 are fed via line 108 to the control device 42, which checks that the web 28 is running in synchronism with the transfer belts 94, 96. Should any lack of synchronism be detected, the control device adjusts the speed of the motor 76 in compensation. Almost immediately after the web 28 starts to move, the control device 42 causes the stepper motors 98 and 99 to be operated to close the transfer stations 45 and 80, bringing the paper web 28 into contact with the transfer belts 94, 96. The timing of these operations, as measured in terms of predetermined numbers of encoder pulses received by the control device 42, is such that the web 28 is brought into contact with the first transfer belt 94 just as the initial first image 16 on the transfer belt 94 reaches the transfer station 45. Similarly, the web 28 is brought into contact with the second transfer belt 96 just as the initial second image 64 on the second transfer belt 96 reaches the transfer station 80.

In this manner, the first and second initial images are printed in back-to-back registration with each other, close to the leading end of the web 28, thereby avoiding significant wastage of web material.

We claim:

1. A multi-color duplex printer comprising:

a first transfer surface drive device for driving a first transfer surface carrying a first multi-color toner particle image to a first transfer station at which said first multi-color toner particle image is transferred to one face of a substrate web;

a second transfer surface drive device for driving a second transfer surface carrying a second multi-color toner particle image on said second transfer surface to a second transfer station at which said second multi-color toner particle image is transferred to the opposite face of said substrate web;

a web drive device for driving said substrate web through said first and second transfer stations;

a first transfer surface movement sensor for sensing movement of said first transfer surface;

a second transfer surface movement sensor for sensing movement of said second transfer surface; and a control device for controlling said first, and second transfer surface drive devices and said web drive device in response to signals received from said first and second transfer surface movement sensors thereby to ensure desired registration between said first and second multiple toner images at a desired location on said substrate web.

2. A printer according to claim 1, wherein each said transfer surface is an endless transfer belt.

3. A printer according to claim 1, wherein each said transfer surface movement sensor is in the form of an encoder.

4. A printer according to claim 3, wherein said encoder is a rotational encoder associated with an image forming drum which is in contact with a primary belt to deposit toner particle images thereon, said primary belt being in operative contact with said transfer surface to enable said toner particle image to be transferred to said transfer surface.

5. A printer according to claim 1, wherein each said transfer station has an open position in which said substrate web is separated from the respective transfer surface and a closed position in which said substrate web makes contact with said respective transfer surface.

6. A printer according to claim 5, wherein said control device is adapted to control the closure and opening of each said transfer station.

7. A printer according to claim 6, wherein said second transfer station is downstream of said first transfer station, and each said transfer station comprises a movable counter roller in rolling contact with said substrate web, said counter roller being movable between a position in which said counter roller forms a nip with said respective transfer surface, through which nip said substrate web passes, and a position spaced from said respective transfer surface.

8. A printer according to claim 1, further comprising a web movement sensor for sensing movement of said substrate web, said control device being adapted to control said web drive device in response to signals received from said first and second transfer surface movement sensors and from said web movement sensor to ensure synchronous movement of said substrate web with said first and second transfer surfaces.

9. A method of multi-color duplex printing comprising:

driving a first transfer surface carrying a first multi-color toner particle image to a first transfer station at which said first multi-color toner particle image is transferred to one face of a substrate web;

driving a second transfer surface carrying a second multi-color toner particle image on said second transfer surface to a second transfer station at which said second multi-color toner particle image is transferred to the opposite face of said substrate web;

driving said substrate web through said first and second transfer stations;

sensing movement of said first transfer surface;

sensing movement of said second transfer surface; and controlling the movement of said first and second transfer surfaces and said substrate web in response to signals received from said first and second transfer surface movement sensors thereby to ensure desired registration between said first and second multiple toner images at a desired location on said substrate web.

10. A method according to claim 9, wherein, at start-up of the printer, movement of said substrate web is delayed to ensure the positioning of said first and second multiple toner images at a predetermined location on said substrate web.

11. A method according to claim 10, wherein at start-up of the printer, initial movement of said transfer surfaces occurs while said substrate web is stationary and separated from said transfer surfaces at said transfer stations.

12. A method according to claim 9, further comprising sensing movement of said substrate web, and controlling said web drive device in response to signals received from said first and second transfer surface movement sensors and from said web movement sensor to ensure synchronous movement of said substrate web with said first and second transfer surfaces.

* * * * *